US005868273A

United States Patent [19]

Daenen et al.

[11] Patent Number: 5,868,273

[45] **Date of Patent: *Feb. 9, 1999**

[54] CANISTER WITH PRESSURE RESISTANT SEALING LID

[75] Inventors: Robert H. C. M. Daenen, Essene; Nele Wallays, Antwerp, both of Belgium

[73] Assignee: Dart Industries Inc., Orlando, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 729,112

[22] Filed: Oct. 11, 1996

[51] Int. Cl.[6] ..... B65D 39/00

[52] U.S. Cl. ..... 220/795; 220/780; 220/378; 215/341

[58] Field of Search ..... 277/180, 227; 425/809, DIG. 47; 264/273, 268; 220/795, 806, 789, 790, 801, 802, 803, 804, 378, 792, 780, 100, 102; 215/317, 321, 341, 343, 345–347, DIG. 1, 354

[56] References Cited

U.S. PATENT DOCUMENTS

| | | | |
|---|---|---|---|
| 3,354,249 | 11/1967 | Morin | 264/273 X |
| 3,360,153 | 12/1967 | Wheaton, Jr. . | |
| 4,206,499 | 6/1980 | Urbanek et al. | 220/378 X |
| 4,223,800 | 9/1980 | Fishman . | |
| 4,261,475 | 4/1981 | Babiol | 215/341 |
| 4,312,824 | 1/1982 | Mori et al. | 264/268 X |
| 4,331,249 | 5/1982 | Banich, Sr. | 215/343 |
| 4,380,304 | 4/1983 | Anderson | 215/DIG. 1 X |
| 4,494,674 | 1/1985 | Roof . | |
| 4,570,811 | 2/1986 | Lecinski et al. | 215/343 |
| 4,588,105 | 5/1986 | Schmitz et al. | 220/787 |
| 4,697,716 | 10/1987 | Mumford | 215/341 X |
| 4,708,259 | 11/1987 | Olimpio . | |
| 4,881,658 | 11/1989 | VanCucha . | |
| 4,896,782 | 1/1990 | Hawkins et al. | 215/341 X |
| 5,103,993 | 4/1992 | Bingisser . | |
| 5,161,711 | 11/1992 | Picozza et al. . | |
| 5,181,626 | 1/1993 | Daenen et al. . | |
| 5,207,340 | 5/1993 | Cochrane | 215/256 |
| 5,297,688 | 3/1994 | Beck et al. | 215/DIG. 1 X |
| 5,395,003 | 3/1995 | Matsuda . | |
| 5,417,337 | 5/1995 | Robbins, III . | |
| 5,421,470 | 6/1995 | Dudzik | 215/354 X |
| 5,460,287 | 10/1995 | Cargile et al. . | |

FOREIGN PATENT DOCUMENTS

| | | | |
|---|---|---|---|
| 0062122 | 10/1982 | European Pat. Off. . | |
| 1152487 | 2/1958 | France | 215/341 |
| 1335073 | 7/1963 | France | 215/343 |
| 2340865 | 9/1977 | France . | |
| 2535814 | 5/1984 | France . | |
| 3830792 | 5/1989 | Germany | 220/1 |
| 583034 | 10/1958 | Italy | 264/267 |
| 48001 | 1/1980 | Japan | 264/273 |
| 48801 | 1/1988 | Japan | 264/268 |
| 6714308 | 4/1969 | Netherlands . | |

*Primary Examiner*—Stephen K. Cronin
*Assistant Examiner*—Robin A. Hylton
*Attorney, Agent, or Firm*—John A. Doninger

[57] ABSTRACT

A canister including a canister body with a removable lid, incorporating a seal element of elastomeric material, releasably mountable to the canister body. The seal element, bonded to the lid, includes a first sealing surface engaging and sealing to the upper edge of the canister body, and a sealing bead spaced below the sealing surface and engaging and defining a seal with the inner surface of the canister body.

3 Claims, 3 Drawing Sheets

CANISTER WITH PRESSURE RESISTANT SEALING LID

BACKGROUND OF THE INVENTION

The present invention is concerned with canisters of the type conventionally used for the storage and preservation of foodstuffs, for example, sugar, flour, rice, biscuits, snack foods, and the like. Such canisters are frequently provided in sets, and while normally used in the home, can also be used to contain foodstuffs for purchase in stores.

The principal problem with known canisters is the difficulty in obtaining an effective sealing or closing of the canister to provide a liquid tight and airtight container, while at the same time providing a lid or closure which effectively resists internal pressure build-up and is easily secured to and released from the canister body.

With regard to the problem of pressure build-up, both as the cover is mounted and due to any food-generated gases, it has in the past been known to provide vents. However, such vents will frequently affect the integrity of the seal, and the actual formation of the vents requires precision manufacturing techniques within rather confining parameters.

SUMMARY OF THE INVENTION

The canister of the invention is to be configured in the manner of a conventional canister, that is preferably round or rectangular, and will include a removable cover. In distinguishing over the prior art, the canister is provided with a unique dual sealing system wherein the cover, through a separate seal element or ring molded therewith, effectively seals to the canister in two distinct areas, the upper edge of the canister and the inner surface of the canister downwardly spaced from the upper edge.

Another aspect of the invention is the accommodation of internal pressure without the necessity of specifically defined vents which could in turn affect the air and/or water tightness of the seal.

In addition to the specific advantages of the canister as to the improved seal and enhanced ability to accommodate internal pressure, the cover itself is both easy to apply to the canister body and readily removable therefrom as required if the canister is to find ready acceptance in the home.

Structurally, the canister includes a canister container or body and a cover or lid. The canister body, for purposes of illustration, has been presented as a cylindrical body receiving a circular lid. The lid has an integral depending peripheral flange with an inwardly directed bead continuously thereabout and snap-engaged beneath a similar bead integral with and outwardly projecting from the wall of the canister body immediately below the upper edge thereof.

A soft, resilient seal element is autogenously bonded to the lid, preferably using a double shot molding process, and extends continuously thereabout immediately inward of the peripheral flange. The seal element, upon a full engagement of the lid, defines two distinct seal areas between the lid and the canister body, both seal areas extending peripherally about the canister wall and defining a pair of laterally spaced seals precluding any passage of air or liquid between the interior of the canister and the ambient atmosphere. The first seal area is defined by a planar bottom face of the seal element which seats on and is snugly retained against the smooth upper edge of the wall by means of the interlocking beads respectfully on the lid flange and the outer surface of the wall. The second seal area comprises a peripheral dependent flange as an integral extension of the sealing element which is positioned to generally parallel the inner face of the body wall peripherally thereabout and in slightly inwardly spaced relation thereto. This sealing element flange includes an outwardly directed peripheral bead above the lower edge thereof which tightly engages against the inner surface of the body wall and is retained in sealing engagement thereagainst by the inherent resiliency of the seal element.

The positioning of the sealing element flange in slightly inwardly spaced relation to the inner face of the body wall provides an expansion or pressure accommodating space above the sealing bead whereby any internal pressure build-up, either as the lid is applied or subsequent thereto, can be accommodated by a lateral outward flexing of this sealing element flange. This will not adversely affect the sealing bead thereon, and in fact will enhance the sealing effect.

Other features and advantages of the invention will become apparent from the more detailed description following hereinafter.

DESCRIPTION OF THE PREFERRED EMBODIMENTS

Figure 1:
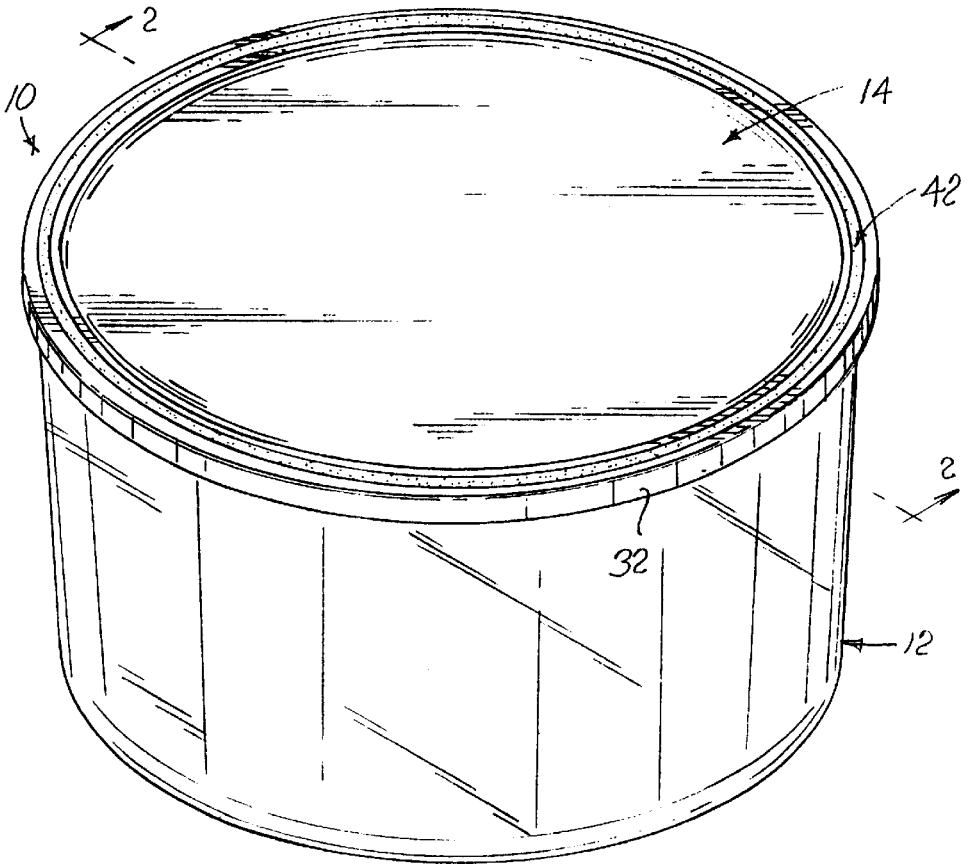
FIG. 1 is a perspective view of the canister of the invention with the lid mounted to the canister body.
Figure 2:
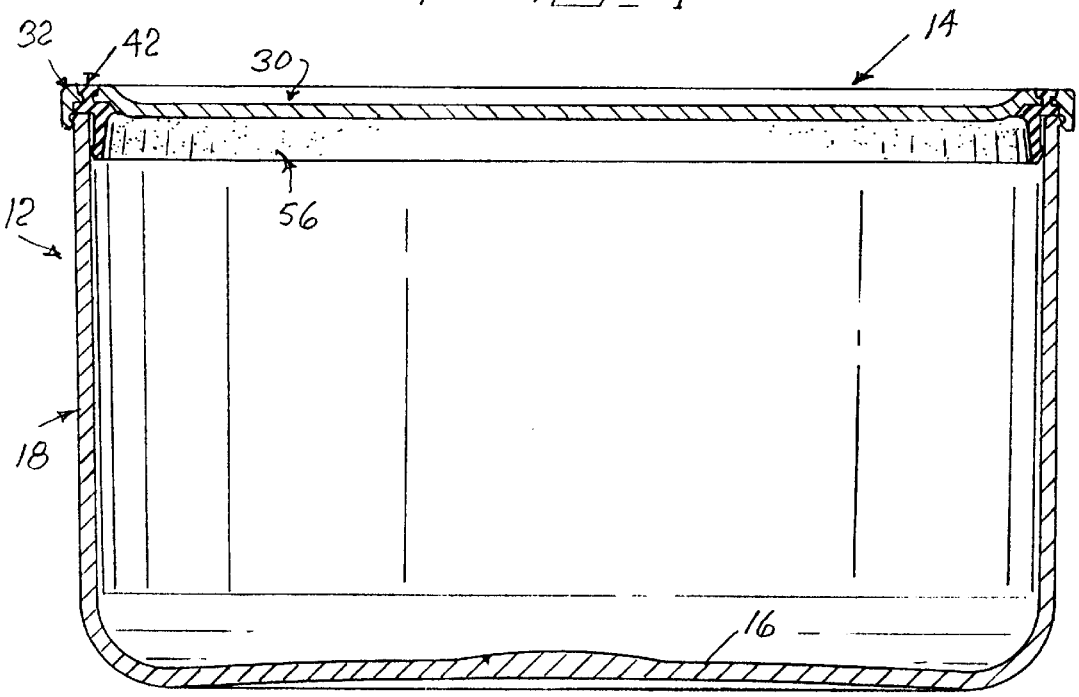
FIG. 2 is an enlarged transverse cross-sectional view taken substantially on a plane passing along line 2—2 in FIG. 1.
Figure 3:
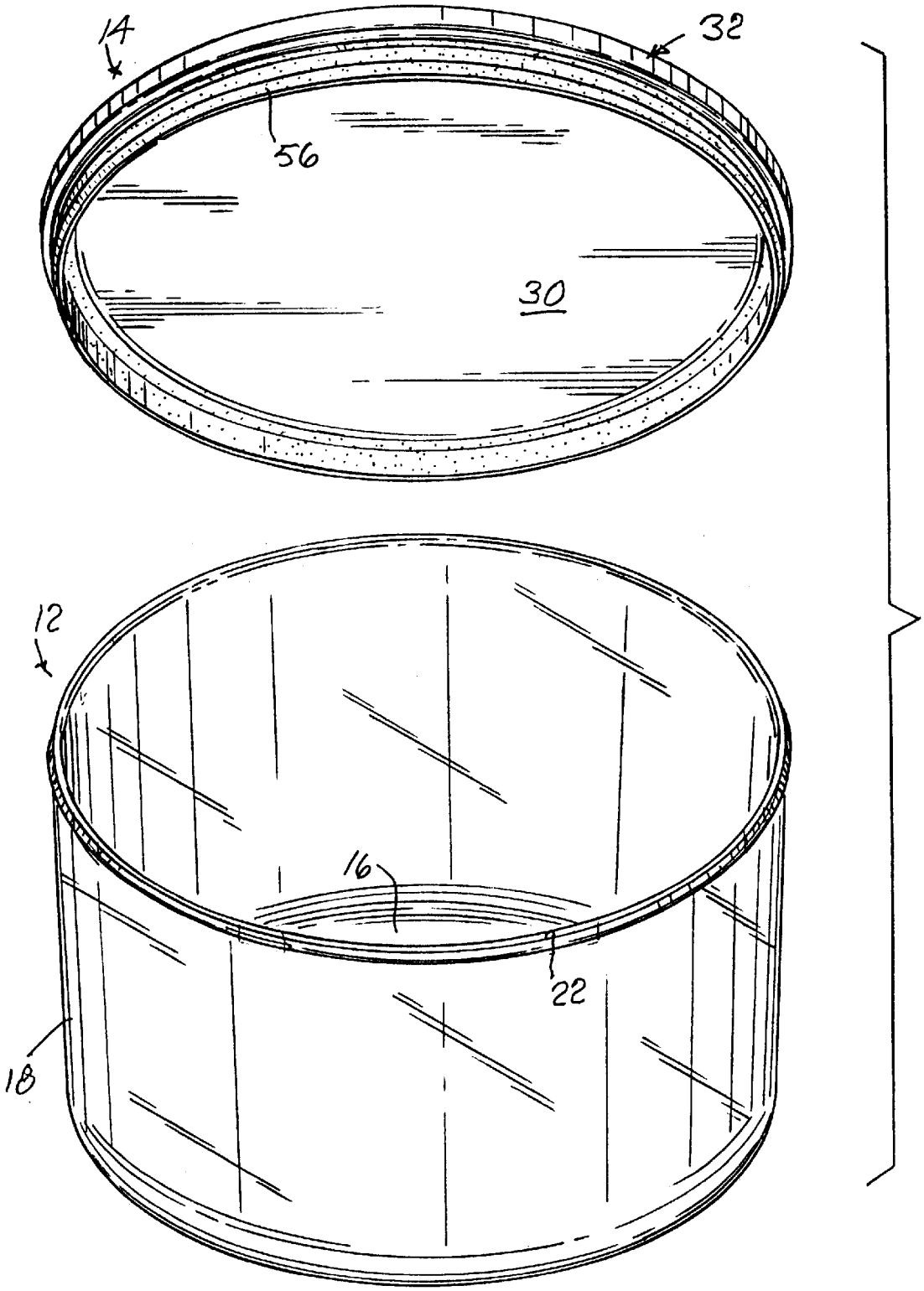
FIG. 3 is a perspective view of the canister with the lid exploded away from the canister body.

Referring now more specifically to the drawings, the canister 10 includes a canister body 12 and a canister lid 14, both formed of an appropriate substantially rigid, food compatible synthetic resinous material, either or both incorporating a degree of flexible resiliency sufficient to allow for a snap-locking of the lid to the canister body as shall be discussed subsequently.

The canister body 12, which forms the container portion of the canister 10, has a closed bottom 16 with a peripheral wall 18 integral therewith and extending vertically therefrom to terminate in an upper rim portion 20 defining an upwardly opening mouth. The rim portion 20 has a smooth upper edge 22 which extends continuously about the container body in a common plane. The inner face of the body wall 18 is preferably smooth and continuous for the full height thereof. The outer surface, within the rim portion 20, includes an integral outwardly extending locking bead 24 continuously thereabout immediately below the upper edge 22. The bead 24 has a sloping upper edge 26 which converges upwardly toward the upper edge 22 of the wall 18 at a point slightly inward of the outer surface of the wall 18 below the bead 24. As such, it will be recognized that the upper edge 22 is slightly narrower than the thickness of the wall 18 itself. A similar inclined lower edge 28 extends from the outer apex of the bead 24 downwardly and inwardly to the main portion of the wall 18, providing in effect an undercut area immediately below the bead.

Figure 6:
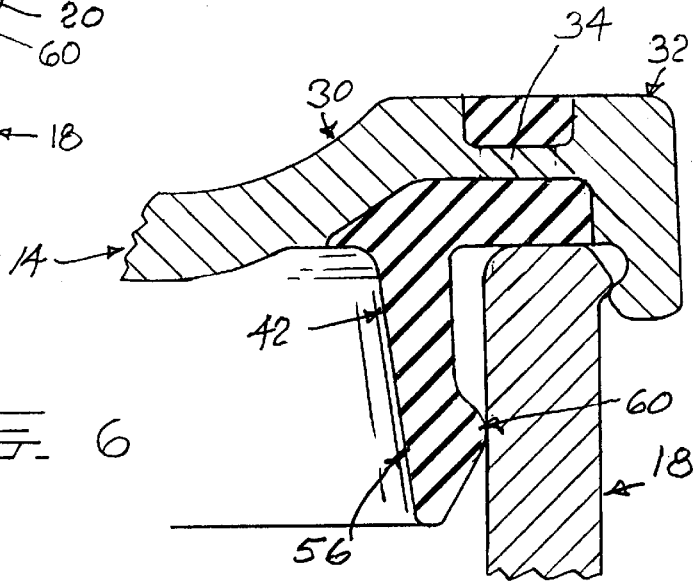
FIG. 6 is a similar cross-sectional detail offset from the detail of FIG. 4 and illustrating the integral web joining the outer peripheral portion of the lid with the main portion of the lid, and about which the seal element is molded.

The lid or cover 14 includes a solid central portion 30 and an outer peripheral edge portion 32 integrally joined to the central portion 30 by a series of peripherally spaced webs 34, only one of which is shown in FIG. 6.

The outer peripheral edge portion 32 of the lid 14 includes a depending peripheral flange 36 with an inwardly directed locking bead 38 continuously thereabout and positioned for snap-locking engagement with the canister wall locking bead 24. This snap-locking engagement of the beads 24 and 38 is achieved by the slight inherent flexible resiliency of one or the other of the body and lid, with the engagement facilitated by the inclined by the upper face 26 on the bead 24 and a similar inclined lower face 40 on the bead 38. The bead 38, when engaged below the bead 24, firmly clamps the lid 14 against the upper edge 22 of the body wall 18, and retains the lid until the lid is manually released by a grasping of the peripheral edge portion 32, and more particularly the flange 36 thereof, and exerting an upward peeling of the lid from the canister body.

The actual sealing of the lid 14 to the canister body 12 is achieved by a seal element or ring 42 of an appropriate elastomeric material softer and more resilient than the material of the lid and body. The seal element is bonded to the central and peripheral edge portions 30 and 32 of the lid 14 and to, and within the spaces between, the connecting webs 34. This is preferably an autogenous bonding by a double shot molding process. Alternatively, the seal element can be preformed with the bonding effected by any known method such as a press fit either with or without an adhesive.

Figure 4:
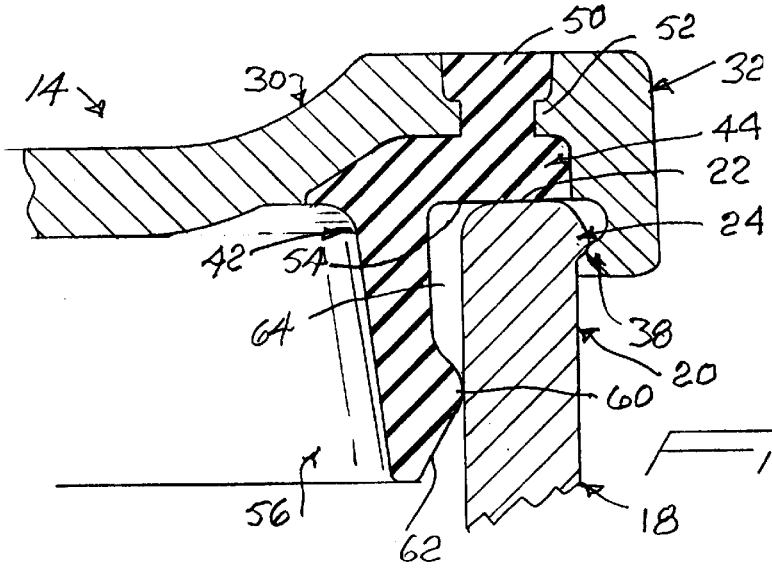
FIG. 4 is an enlarged cross-sectional detail through an upper edge of the canister and illustrating the sealing engagement of the lid with the wall of canister body.
Figure 5:
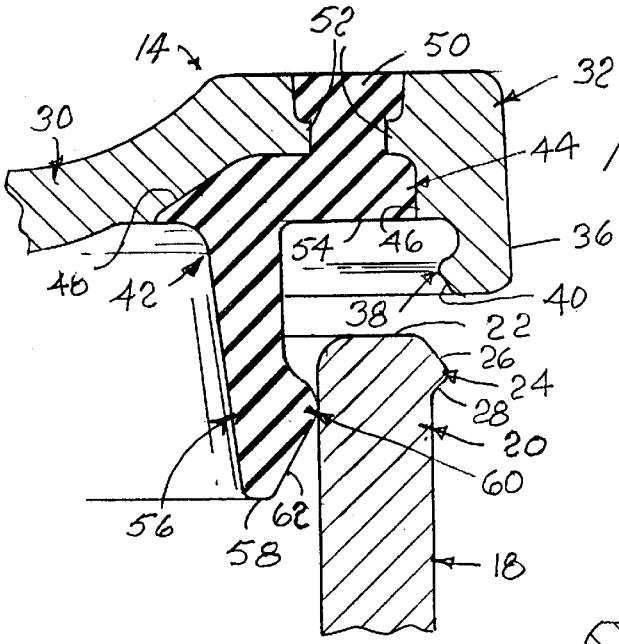
FIG. 5 is a cross-sectional detail similar to FIG. 4 with the lid partially engaged with the canister body.

The seal ring 42, best seen in the cross-sectional details of FIGS. 4–6, includes a body portion 44 substantially rectangular in cross-section and received within a similarly configured recess 46 defined within the lower surface of the lid 14 and extending laterally into the lid central portion 30 and peripheral edge portion 32 across the gap defined therebetween by the radially extending webs 34. As illustrated, the section of the seal body portion 44 extending into the lid central portion 30 can have an inclined edge 46 to maintain the general thickness of the central portion 30 of the lid in those instances wherein the central portion includes a depressed central area.

An integral seal locking head 50 extends upward from the seal body portion 44 within the gap between the lid portions 30 and 32 and between and over the connector webs 34 to define a smooth continuous upper surface flush with the adjoining upper surfaces of the lid portions 30 and 32. As noted in FIGS. 4 and 5, the adjacent edges of the lid central portion 30 and peripheral edge portion 32 can include short opposed ribs 52 projecting inwardly toward each other immediately above the seal recess 46 to define a shoulder area for a more effective locking of the seal ring 42 to sections 30 and 32 of the lid.

The lower face or surface 54 of the seal body portion 44 is planar and of a lateral extent as to completely overly the flat upper edge 22 of the body wall 18 of the canister for an effective sealing thereto upon snap-engagement of the locking beads 24 and 38 on the canister body rim 20 and the lid peripheral portion 32 respectively. The actual height between the lower surface 28 of the locking bead 24 on the body rim 20 and the planar upper edge 22 thereof is slightly greater than the height between the lid locking bead 38 and the overlying surface 54 of the seal element whereby, upon an engagement of the locking beads 24 and 38, the seal element 42 is slightly compressed to define a seal which is both airtight and water tight.

The seal element 42 also includes a depending seal flange 56 which is integral with the seal body portion 44 at a point radially inward of the lid outer edge portion 32 so as to, upon a mounting of the lid 14, extend within the canister body 18 as the locking beads 24 and 38 engage. This seal flange 56 extends downward to a lower edge 58 vertically spaced below the seal body bottom face 54 and, when the lid is mounted on the canister body, below the canister body upper edge 22.

It is intended that the seal flange 56 sealingly engage the inner face of the canister body. As such, the seal flange 56 is, downward from the seal body 44, slightly radially outwardly inclined and includes an integral radially outwardly projecting sealing bead 60 which snugly rides against the inner face of the canister body 18 as the lid is mounted. In order to facilitate the proper movement of the seal flange and bead 60 within the container body, the lower face 62 of the bead is beveled or tapered inwardly toward the lower edge 58 of the seal flange 56.

Noting the dimensional relationships in FIG. 5, the transverse width between the sealing bead 60 and the locking bead 38 on the lid outer edge portion thereabove is such as to require an inward flexing of the seal flange 56 both during the engagement of and subsequent to the engagement of the locking beads 24 and 38. In this manner, the sealing bead 60 on the seal flange 56 is constantly resiliently biased into engagement with the inner surface of the body wall 18 to provide a second airtight and water tight seal therewith which, in cooperation with the seal provided between the bottom face 54 on the seal body 44 and the top edge 22 of the canister body 18, effectively precludes any possibility of leakage, while at the same time providing a lid which is easily closed and subsequently opened with minimal manual pressure.

Referring to FIGS. 4 and 6, it will be noted that a vertically elongate space 64 is formed between the seal flange 56 and the adjoining upper portion of the body wall 18. This space 64 is significant in providing a pressure accommodating space. In other words, should internal pressures develop within the canister as the lid is mounted and/or from internal pressure generation, this pressure, rather than tending to dislodge the lid or otherwise affect the sealing relationship, would be accommodated with a slight outward flexing of the seal flange 56 into the space 64. Such a flexing would also enhance the seal at the sealing bead 60.

While the seal element 42 has been described above in cross-section, it is to be appreciated that all of the components of the seal element extend continuously for the full extent thereof, the seal head 50, below the planar upper surface thereof, being periodically interrupted to accommodate the radial webs 34 joining the lid outer edge portion 32 to the central portion 30. Accordingly, upon a mounting of the lid, two continuous seals or sealing lines are provided, one with the upper edge 22 of the container body and the other with the inside wall of the container body against which the sealing bead 60 engages.

As will be appreciated, the illustrated embodiment, presented to enable a complete disclosure of the features of the invention, is not to be considered a limitation on the scope of the invention as variations will occur to those skilled in the art. For example, and most obviously, the canister can be rectangular. Similarly, while the upper body edge 22 has been defined as flat, this edge can be upwardly convex or otherwise formed as long as the edge is in a common plane and presents a surface against which the bottom face 54 of the seal body can intimately and sealingly engage for the full extent thereof.

We claim:

1. A canister lid for removable engagement with a canister body and a sealing thereto along two spaced seal lines; said lid including a central portion and a peripheral edge portion about said central portion and in outwardly spaced relation thereto, said central portion and said peripheral edge portion being substantially rigid, and a softer annular elastomeric seal element bonded to and extending continuously about said central portion and solely adjacent said lid peripheral edge portion with a major portion of said central portion exposed within said annular seal element, said peripheral edge portion including a depending flange terminating in a lower edge, an inwardly directed locking bead integral and continuous with said depending flange adjacent said lower edge for a snap-locking engagement with a corresponding exterior locking bead on a canister body, said seal element including a downwardly directed face inward of said edge portion flange and above said lower edge of said edge portion flange, said seal element further including a depending flange inward of said downwardly directed face and depending therebelow in laterally spaced relation to said substantially rigid edge portion flange and said inwardly directed locking bead, said seal element flange having an outer face facing said edge portion flange and a free lower edge with an integral sealing bead immediately above the sealing element flange lower edge and laterally directed outward beyond said outer face and toward said edge portion flange.

2. A canister comprising a canister body with a body wall defining a canister interior and having an upper rim portion defining an upwardly opening mouth, and a lid releasably engageable with said rim portion in overlying relation to said mouth, cooperating locking means on said body and said lid releasably locking said lid to said body, said lid being substantially rigid, and a separate softer elastomeric seal element fixed to said lid, said seal element having vertically spaced upper and lower sealing components engaged with and sealed to said canister body at two vertically spaced positions completely about said mouth upon a locking of said lid to said body, said wall of said canister body having an outer surface, said locking means including a locking bead integral with said canister body wall and projecting outward from said outer surface peripherally thereabout adjacent said mouth, said canister body wall having a continuous smooth inner face for at least an upper portion of said wall at and below said mouth, said outer surface and said inner face being substantially parallel and defining a predetermined wall thickness therebetween, said canister wall having an upper edge extending between said outer surface and said inner face and of a width substantially equal to the wall thickness, said upper edge extending continuously about the canister, said lid including a central portion and a peripheral edge portion about said central portion in outwardly spaced relation thereto, said peripheral edge portion including an integral depending flange terminating in a lower edge, said locking means further including an inwardly directed locking bead integral and continuous with said depending flange adjacent said lower edge for a snap-locking engagement with said outwardly directed locking bead on the wall of said canister body, said elastomeric seal element being annular and fixed to and extending continuously about said central portion solely adjacent said lid peripheral edge portion with at least a manor area of said central portion exposed within said annular seal element and to a canister body interior defined by said body wall, said upper sealing component including a downwardly directed face inward of said edge portion flange and above said lower edge of said edge portion flange, said elastomeric seal element including a depending flange inward of said downwardly directed face and depending therebelow in laterally spaced relation to said lid edge portion flange, said seal element flange having an outer face facing said inner face of said canister body wall and an inner face facing toward and exposed to the canister interior, wherein said seal element flange is directly exposed to internal pressure within said canister interior, said lower sealing component comprising an integral sealing bead on said seal element flange, said sealing bead being laterally directed outward relative to said outer face of said seal element flange toward said lid edge portion flange, said upper and lower sealing components, upon locking engagement of said locking beads, being intimately compressed respectively against said canister upper edge and said canister inner face peripherally about said canister.

3. The canister of claim 2 wherein said upper and lower sealing components on said seal element, upon a locking of said locking beads of said lid and said body, define a pressure-accommodating space between said upper and lower sealing components for pressure-induced flexure of said elastomeric sealing element flange therein independent of said substantially rigid lid.

* * * * *